US009918522B2

(12) United States Patent
Laatz

(10) Patent No.: US 9,918,522 B2
(45) Date of Patent: Mar. 20, 2018

(54) RATCHET BELT SYSTEM AND RELATED ACCESSORIES

(71) Applicant: Kore Essentials, Inc., San Diego, CA (US)

(72) Inventor: Robin Laatz, San Diego, CA (US)

(73) Assignee: KORE ESSENTIALS, INC., San Diego, CA (US)

( * ) Notice: Subject to any disclaimer, the term of this patent is extended or adjusted under 35 U.S.C. 154(b) by 0 days.

(21) Appl. No.: 15/447,736

(22) Filed: Mar. 2, 2017

(65) Prior Publication Data

US 2017/0172260 A1 Jun. 22, 2017

Related U.S. Application Data

(63) Continuation of application No. 15/066,302, filed on Mar. 10, 2016, now Pat. No. 9,615,631, which is a continuation-in-part of application No. 15/008,394, filed on Jan. 27, 2016, now abandoned, which is a continuation of application No. 14/218,887, filed on Mar. 18, 2014, now Pat. No. 9,277,776.

(60) Provisional application No. 61/896,605, filed on Oct. 28, 2013.

(51) Int. Cl.

| | |
|---|---|
| ***A44B 11/20*** | (2006.01) |
| ***A45F 5/02*** | (2006.01) |
| ***A47F 7/19*** | (2006.01) |
| ***A47F 5/00*** | (2006.01) |
| ***F41C 33/04*** | (2006.01) |

(52) U.S. Cl.

CPC ..... *A44B 11/20* (2013.01); *A45F 5/021* (2013.01); *A47F 5/0006* (2013.01); *A47F 7/19* (2013.01); *F41C 33/046* (2013.01)

(58) Field of Classification Search

CPC ..... A41F 9/002; A41F 9/025; A44B 11/12; A44B 11/125; A44B 11/24; A45C 13/001; A45C 13/30; A47F 5/0006; A47F 7/12; Y10T 24/4072

See application file for complete search history.

(56) References Cited

U.S. PATENT DOCUMENTS 1,887,825 A * 11/1932 Statham ..... A41F 1/008 24/593.11
3,900,923 A * 8/1975 Thomas ..... B65D 63/1072 24/16 PB
4,669,155 A * 6/1987 Chen ..... A41F 9/002 24/170

(Continued)

*Primary Examiner* — Robert Sandy
*Assistant Examiner* — David M Upchurch
(74) *Attorney, Agent, or Firm* — Coastal Patent Law Group, P.C.

(57) ABSTRACT

A ratchet belt system including a belt having a notch strip extending along a portion of the length thereof. The notch strip is formed of a plurality of adjacent notches, each being configured to engage a ratcheting tab of an associated buckle. In an embodiment, the tab is coupled to a release lever that is oriented toward a receptacle portion of the buckle for ergonomically improving the release mechanics. In another embodiment the belt comprises a first notch strip about a first surface of the belt and a second notch strip about a second surface of the belt opposite of the first surface. Other improvements include accessories configured to engage with the ratchet belt system for display and storage thereof.

12 Claims, 9 Drawing Sheets

(56) References Cited

U.S. PATENT DOCUMENTS

| | | | | | |
|---|---|---|---|---|---|
| 5,572,747 | A * | 11/1996 | Cheng | A44B 11/12 | 2/312 |
| 5,579,563 | A * | 12/1996 | Sim | A41F 9/002 | 24/170 |
| 5,588,186 | A * | 12/1996 | Ko | A44B 11/14 | 24/170 |
| 5,752,298 | A * | 5/1998 | Howell | A42B 3/166 | 2/418 |
| 5,774,952 | A * | 7/1998 | Ito | A41F 1/008 | 24/578.15 |
| 6,067,662 | A * | 5/2000 | Sim | A44B 11/14 | 2/322 |
| 6,148,485 | A * | 11/2000 | Wu | A44B 11/14 | 24/163 R |
| 6,219,889 | B1 * | 4/2001 | Lovato | A44B 11/12 | 24/170 |
| 6,715,449 | B1 * | 4/2004 | Jordan | A01K 27/005 | 119/863 |
| 7,942,723 | B2 * | 5/2011 | Fildan | A41F 1/006 | 24/585.11 |
| 8,056,190 | B2 * | 11/2011 | Hsieh | A44B 11/16 | 24/115 H |
| 8,689,364 | B2 * | 4/2014 | Rowland | A41F 9/025 | 2/311 |

* cited by examiner

RATCHET BELT SYSTEM AND RELATED ACCESSORIES

CROSS-REFERENCE TO RELATED APPLICATIONS

This application is a continuation of U.S. Ser. No. 15/066,302, filed Mar. 10, 2016;

which is a continuation in part of U.S. Ser. No. 15/008,394, filed Jan. 27, 2016, which is now abandoned;

which is a continuation of U.S. Ser. No. 14/218,887, filed Mar. 18, 2014, now U.S. Pat. No. 9,277,776, issued Mar. 8, 2016;

which further claims benefit of priority with U.S. Provisional Ser. No. 61/896,605, filed Oct. 28, 2013;

the contents of each of which are hereby incorporated by reference.

BACKGROUND

Field of the Invention

This application relates to the field of belts and belt buckles; and more particularly, to a ratcheting belt system and related accessories.

Description of the Related Art

Belts and associated belt buckles, collectively "belt systems", have been long used for the purpose of maintaining fitment of pants against ones waistline.

More recently, ratchet belts have been disclosed which do not contain traditional holes and a penetrating retainer pin, but instead are configured to slide the belt portion through the buckle and engage with a ratcheting buckle to a fitted position. Although these advancements are improved in view of the more traditional hole and pin belts, there are a number of limitations with current ratcheting belt systems.

For example, the release tab lever on conventional ratcheting belts is oriented such that a user is required to pull the lever away from the user's body. These levers have proven cumbersome and difficult to operate. There is a need for an improved lever system for releasing the belt from a ratcheting tab of the buckle.

Moreover, conventional ratchet belts are limited with only one "track" of ratcheting teeth or notches. There has yet to be described in the art a reversible ratchet belt.

These and other limitations in the art are addressed in the enclosed detailed description of the preferred embodiments.

SUMMARY

A ratchet belt is described, the ratchet belt includes: a belt extending from a first terminal end to a second terminal end along a length thereof, the belt having a first surface and a second surface opposite of the first surface; and a buckle having a receptacle portion thereof being configured to attach with the belt at the first terminal end, and a slot portion configured to slideably receive at least the second terminal end of the belt therethrough. The ratchet belt is further characterized in that the belt comprises: a first notch strip at least partially extending along the first surface of the belt and positioned adjacent to the second terminal end thereof; the first notch strip comprising a plurality of notches being aligned in series one adjacent to another along the notch strip, wherein each of the notches individually comprises a vertical wall extending upwardly from a recessed base toward the first surface of the belt and a tapered wall extending from the recessed base to the first surface, the tapered wall forming an angle with the vertical wall, wherein the angle is less than ninety degrees; and the buckle comprises: a ratcheting tab configured to engage the vertical wall of one or more of the notches of the first notch strip; and a release lever coupled to the ratcheting tab, the release lever being configured to rotationally disengage the ratcheting tab from the notch strip for releasing the belt; wherein the release lever extends outwardly from the ratcheting tab and oriented toward said slot portion of the buckle.

In certain embodiments, the ratchet belt is configured to engage with a supplemental accessory through the ratcheting mechanism of the buckle. The supplemental accessory may include a closet hanger, a retail rack hanger, or other device comprising a notch strip.

Other features and advantages are described in the following detailed description of the preferred embodiments.

BRIEF DESCRIPTION OF THE DRAWINGS

The enclosed detailed description will be understood by those having skill in the art upon a thorough review hereof in conjunction with the appended drawings, wherein.

DETAILED DESCRIPTION OF THE PREFERRED EMBODIMENTS

Figure 1:
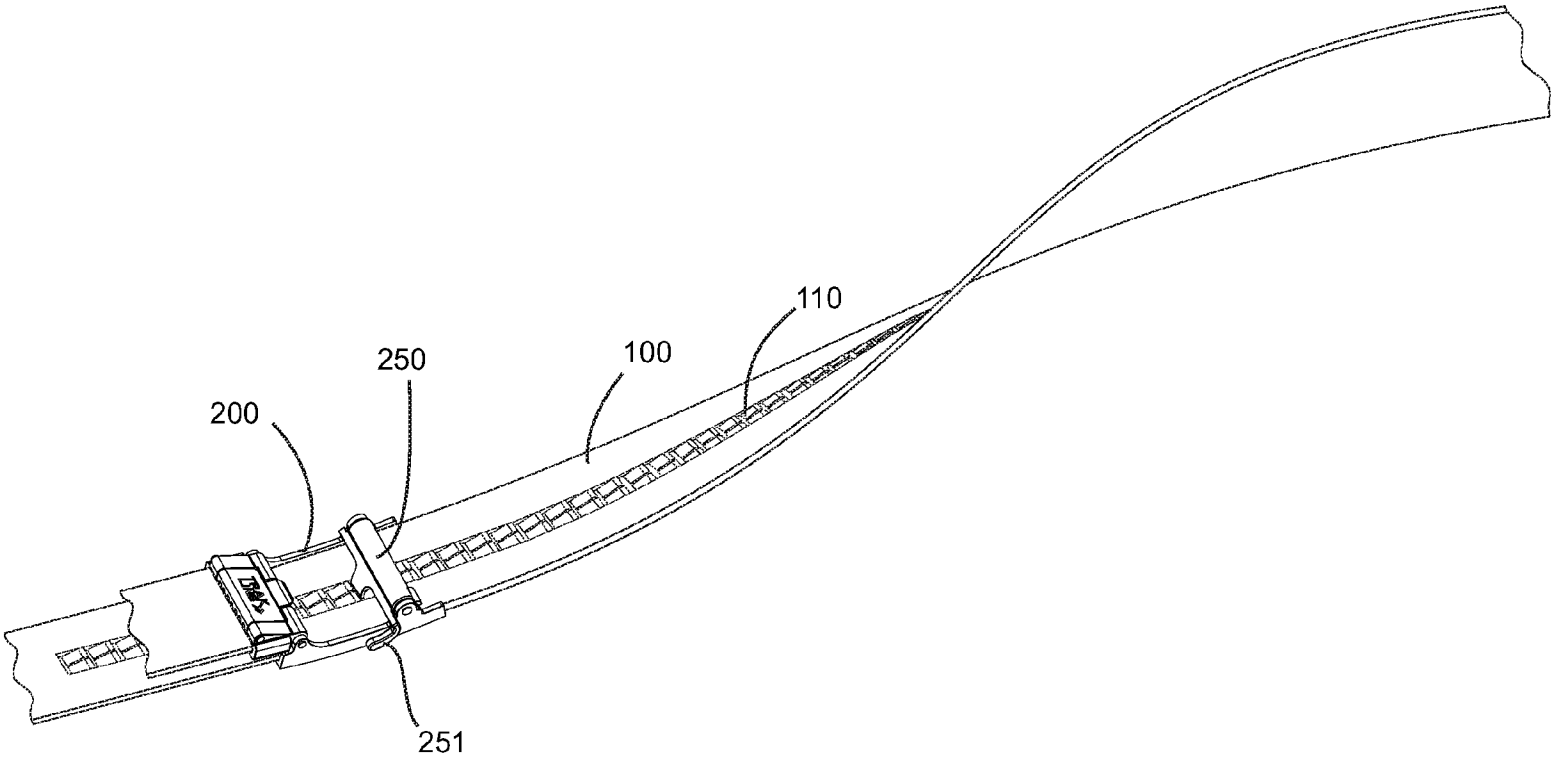
FIG. 1 shows a ratchet belt system in accordance with an embodiment.

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions without departing from the spirit and scope of the invention. Certain embodiments will be described below with reference to the drawings wherein illustrative features are denoted by reference numerals.

Although the term "notch" is used herein to describe a well or etched portion of a track for which a tab of the buckle is configured to engage, the term "notch" as used herein is not intended to include the conventional type hole that penetrates the belt through both surfaces thereof. Instead, none of the notches of the belts described herein penetrates the belt through both surfaces. Each notch as defined herein includes a recessed well extending into a volume of the belt and from a recessed base to a belt surface and positioned between a vertical wall and a tapered wall of adjacent notches as illustrated in FIGS. 3(A-B).

Now turning to the drawings, FIG. 1 shows a ratchet belt system in accordance with an embodiment. The ratchet belt comprises a belt 100 and a buckle 200. The belt extends along a length thereof from a first terminal end to a second terminal end opposite of the first terminal end, however only a portion of the belt is shown for simplicity. The belt comprises a first surface extending along the length of the belt, and a second surface opposite of the first surface. The buckle comprises a receptacle portion configured to receive a portion of the belt at the first terminal end thereof, and further comprises a slot portion 110 configured to receive a portion of the belt therethrough. The belt comprises a notch strip extending along a portion of the belt length adjacent to the second terminal end. The second terminal end of the belt is inserted through the slot portion and a ratcheting mechanism 250 of the buckle is configured to engage the slot portion of the belt for secure and incremental fitting. The second terminal end of the belt is configured for slideably ratcheting through the slot portion of the buckle in a first tightening direction. The ratcheting mechanism further comprises a release tab 251 coupled to the ratcheting mechanism for releasing the belt. A vertical wall of each notch of the belt is individually configured to engage said ratcheting tab for preventing translation of the belt in a release direction opposite of the tightening direction.

Figure 2:
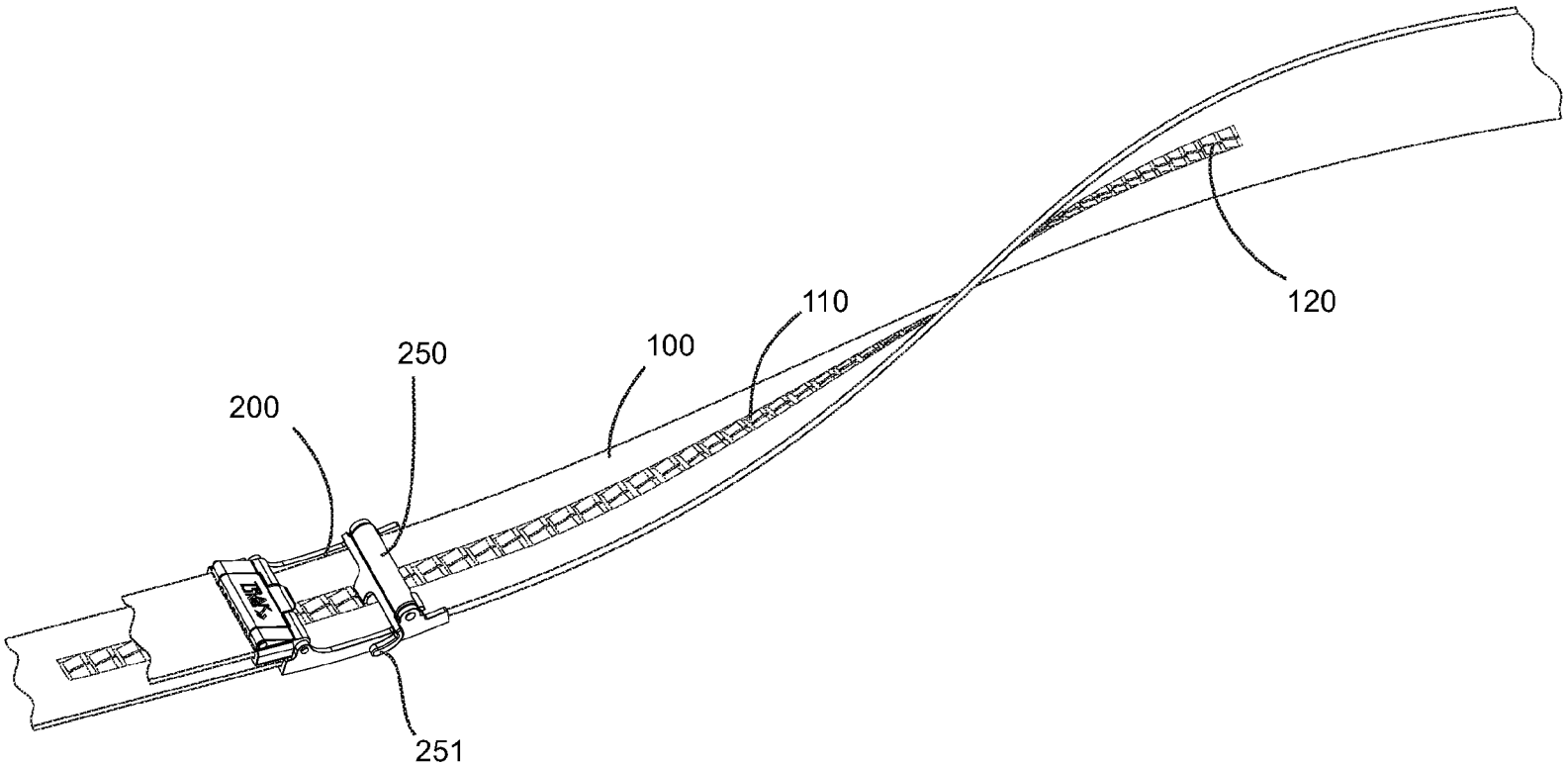
FIG. 2 shows a ratchet belt system with dual sided notch strip tracks for reversible use.

In another embodiment, as illustrated in FIG. 2, a ratchet belt system with dual sided notch strip tracks for reversible use is provided. In this embodiment, the belt comprises a first surface with a first ornamentation thereof and a first notch strip 110, and further comprises a second surface with a second ornamentation thereof and a second notch strip 120. Each of the first and second notch strips are configured to engage with the ratcheting mechanism of the buckle for secure and incremental fitting.

In a preferred embodiment, the notch strip is fabricated from a monolithic piece. Several tests have indicate that when two opposing notch strips are embedded within a belt, each of the notch strips and the belt portions thereabout tend to bunch together and cause damage to the belt. To overcome this, it is proposed that a monolithic insert be fabricated, the monolithic insert comprising a first notch strip on a first side thereof and a second notch strip on a second opposing side. Tests have confirmed that use of a monolithic piece having opposing notch strips can be inserted into a belt and used with the ratcheting buckle without the limitations described above. In some embodiments, the insert can extend beyond the notch strip up to the entire length of the belt within which it is implemented.

Figure 3A:
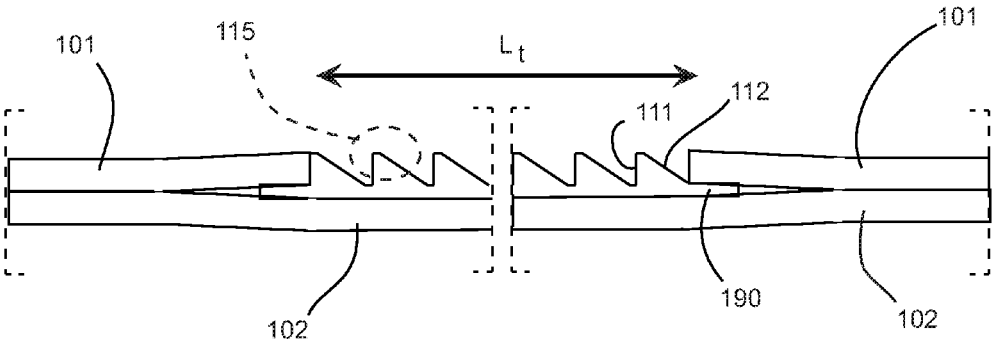
FIG. 3A shows a portion of a belt with a single-side notch strip in accordance with an embodiment.

FIG. 3A shows a portion of a belt with a single-side notch strip in accordance with an embodiment. In this embodiment, a monolithic insert 110 comprises a notch strip having a plurality of notches 115 extending along a track length $L_t$ in series orientation one adjacent to another. Each notch 115 of the notch strip 110 comprises a vertical wall 111 extending upwardly from a recessed base toward a first surface of the belt, and a tapered wall 112 extending from the recessed base toward the first surface, with the tapered wall of a first notch forming an angle with the vertical wall of an adjacent notch that is less than ninety degrees, or an acute angle. The vertical wall of each respective notch of the notch strip is generally oriented to face the first terminal end of the belt such that the wall is configured for engagement with the ratcheting tab of the buckle. The monolithic insert can be embedded or otherwise attached with a belt. In the illustrated embodiment, a second belt layer 102 is positioned beneath the monolithic insert and a first belt layer 101 is overlaid above the second belt layer, the first layer having an etched area for exposing the monolithic notch strip insert. Those having skill in the art will recognize multiple variations for attaching a monolithic insert with a belt, and this example is for illustrative purposes of one embodiment only. Moreover, those with skill in the art can incorporate two or more monolithic inserts collectively extending about a portion or up to the length of the belt.

Figure 3B:
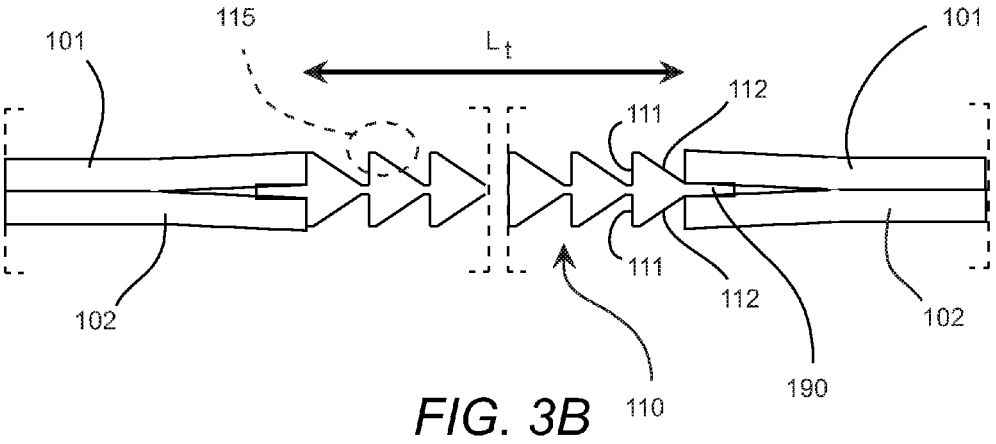
FIG. 3B shows a portion of a belt with a dual-sided notch strip in accordance with another embodiment; the notch strip consists of a monolithic piece with notches on opposing sides and is configured for embedding within a portion of a belt.

In another embodiment, as illustrated in FIG. 3B, a portion of a belt with a dual-sided notch strip is provided. The notch strip consists of a monolithic piece with strips and notches thereof on opposing sides, and is configured for embedding within a portion of a belt. In this embodiment, a monolithic insert 190 comprises a first notch strip having a plurality of notches 115 extending along a track length $L_t$ in series orientation one adjacent to another is disposed on a first side, and a second notch strip having a plurality of notches 115 extending along a track length $L_t$ in series orientation one adjacent to another is disposed on a second side opposite of the first side. Each notch 115 of the monolithic notch strip insert 110 comprises a vertical wall 111 extending upwardly from a recessed base toward a first surface of the belt, and a tapered wall 112 extending from the recessed base toward the first surface, with the tapered wall of a first notch forming an angle with the vertical wall of an adjacent notch that is less than ninety degrees, or an acute angle. The monolithic insert can be embedded or otherwise attached with a belt. In the illustrated embodiment, a second belt layer 102 is positioned beneath the monolithic insert and a first belt layer 101 is overlaid above the second belt layer, the first and second layers each having an etched area for exposing the monolithic notch strip insert at either opposing side or surface of the belt. Those having skill in the art will recognize multiple variations for attaching a monolithic insert with a belt, and this example is for illustrative purposes of one embodiment only. A monolithic insert can be used for rigidity and support by extending the portions on either side of the notch strip about an extended portion, or up to the entire length, of the belt for which it is enclosed. Those with skill in the art will appreciate that the belt can include three layers, including a first belt layer, a second belt layer, and a monolithic insert disposed therebetween. For example, the first and second belt layers can be positioned on either side of the insert, and formed around the insert so as to captivate and embed the monolithic insert.

Figure 4:
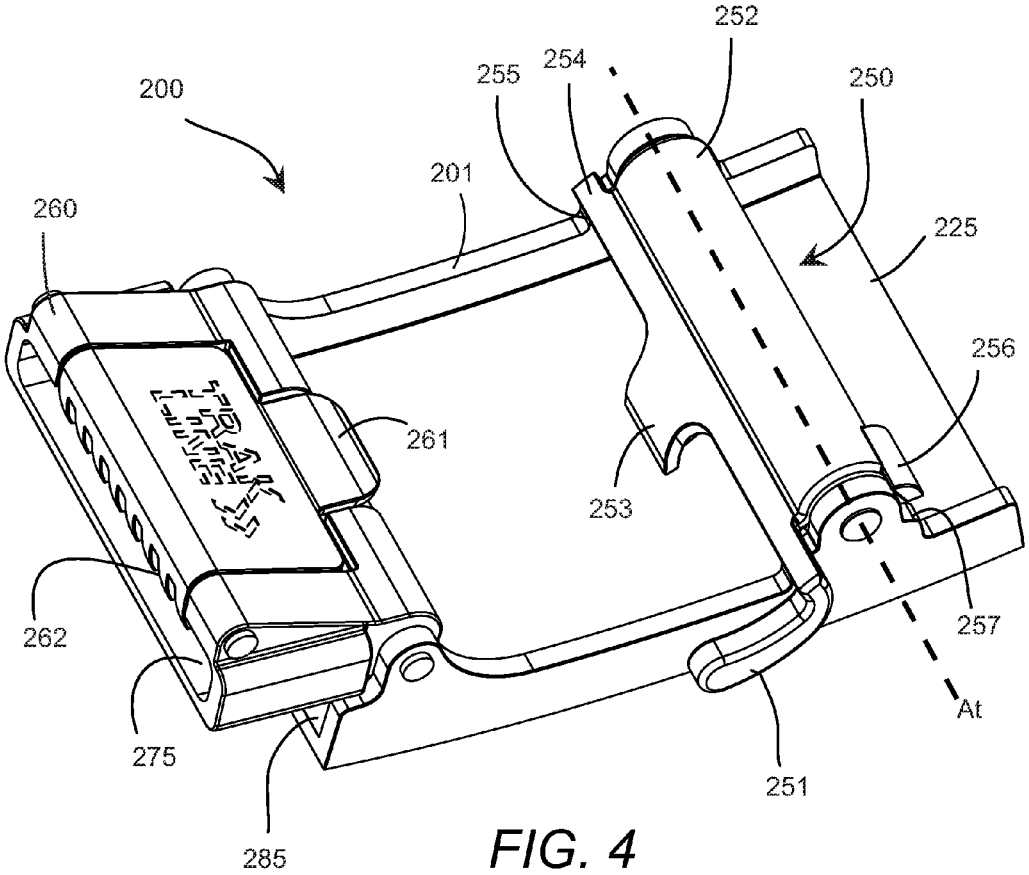
FIG. 4 shows a rear side of a buckle of the ratchet belt system.

FIG. 4 shows a rear side of a buckle of the ratchet belt system. The buckle 200 comprises a buckle body 201, a ratcheting mechanism 250 disposed at a first side 225 and a receptacle portion 260 disposed at a second side 275 of the buckle opposite of the first side. The ratcheting mechanism 250 comprises a tubular body 252 extending along a rotational tab axis $A_r$, a tab 253 and a release lever 251, each of the tab and release lever extending outwardly from the tubular body toward the second side 275 of the buckle 200. The ratcheting tab 253 is configured to engage with a vertical wall of a notch of the plurality of notches within the notch strip inserted through the buckle. The release lever 251 is configured to rotationally disengage the ratcheting tab from the notch strip for releasing the belt from the buckle.

The ratcheting mechanism further comprises a torsion spring 258 (See FIG. 6) configured to provide a spring bias with the tab in a closed position abutting an inner surface of the buckle, or an inserted belt. Although a torsion spring is shown, those with skill in the art will recognize that other springs and similar mechanisms can be provided. A key feature of the illustrated embodiment includes the release lever being positioned on an underside of the buckle and oriented to extend outwardly from the tubular body toward the second side 275 of the buckle such that a release of the belt is effectuated only by pushing the release lever toward the body. In this regard, the belt is never unintentionally released by the body when a user sits or bends down.

The ratcheting mechanism further comprises a plurality of mechanical stops for preventing over-rotation of the ratcheting mechanism. A first mechanical stop is formed of a first mechanical stop tab 254 and a first groove 255. As the ratcheting mechanism is spring-biased the first mechanical stop prevents over-rotation of the system in a first rotational direction (locking) about the rotational tab axis. A second mechanical stop is formed of a second mechanical stop tab 256 and a second groove 257. As the ratcheting mechanism is actuated in a second rotational direction (releasing) about the rotational tab axis by depressing the release lever, the second mechanical stop is configured to abut the second groove for preventing over-rotation of the ratcheting mechanism. Additional details regarding the illustrated ratcheting mechanism are further described in FIG. 6 and the associated description below.

The receptacle portion 260 disposed at the second side 275 of the buckle 200 comprises a cam-style hinge 262 for attaching with the first terminal end of the belt. The hinge further comprises a thumb tab 261 for releasing the belt from the hinge. An exit slot 285 guides the belt to exit after entering through the first side. The hinged clamp extends to allow a user to disengage the buckle from the belt using his or her fingers, and does not require additional tools for applying leverage to open the hinged clamp.

Figure 5:
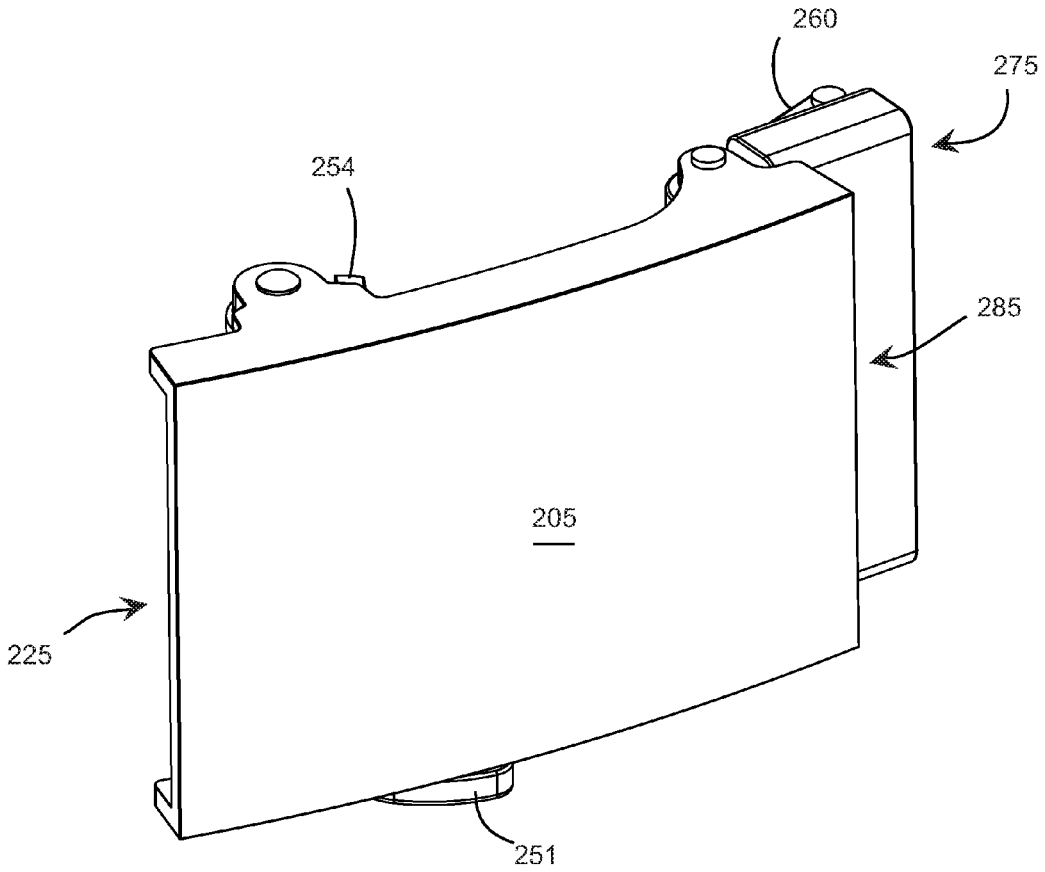
FIG. 5 shows a front side of the buckle.

FIG. 5 shows a front side of the buckle. The buckle comprises an outer surface 205 having ornamentation thereof (not shown). The buckle further comprises a first side 225 configured to receive at least a portion of the belt entering the buckle therethrough, and a second side 275 opposite of the first side, with an exit slot 285 configured to guide the portion of the belt to exit the buckle at the second side. The release lever 251, first mechanical stop tab 254, and receptacle portion 260 are shown form the front view of FIG. 5.

Figure 6:
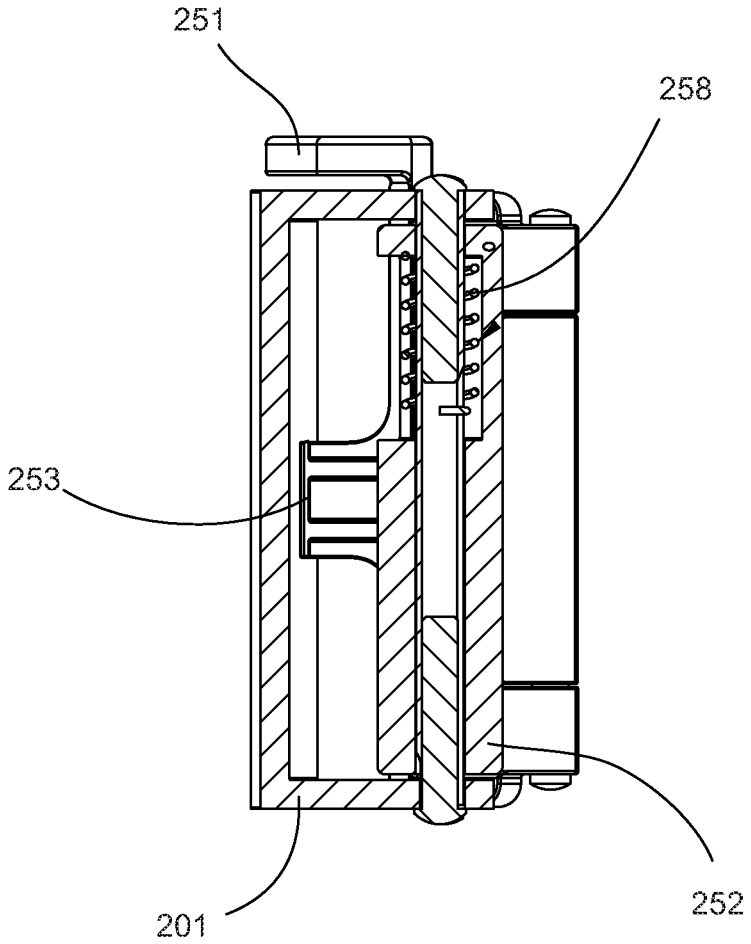
FIG. 6 shows a cross section of the buckle at the ratcheting mechanism thereof.

FIG. 6 shows a cross section of the buckle at the ratcheting mechanism thereof. The buckle comprises a body portion 201 coupled to and supporting the ratcheting mechanism. The ratcheting mechanism further comprises a torsion spring 258 housed within the tubular body 252 and configured to engage with the tubular body at a first spring terminus, and the body portion at a second spring terminus opposite of the first terminus. In this regard, as the tubular body is rotated, the torsion spring is compressed such that upon release of the release lever 251 the tubular body is spring-biased toward a closed position (locking) such that the tab extending from the tubular body is engaged with a notch of an inserted notch strip of the belt.

In an embodiment (not shown) the belt comprises a plurality of size markings disposed adjacent to said first terminal end, wherein each of the plurality of size markings is configured for identifying a belt length at which a user can make a cut prior to inserting and attaching with the receptacle portion of the buckle for user-performed belt sizing.

Figure 7:
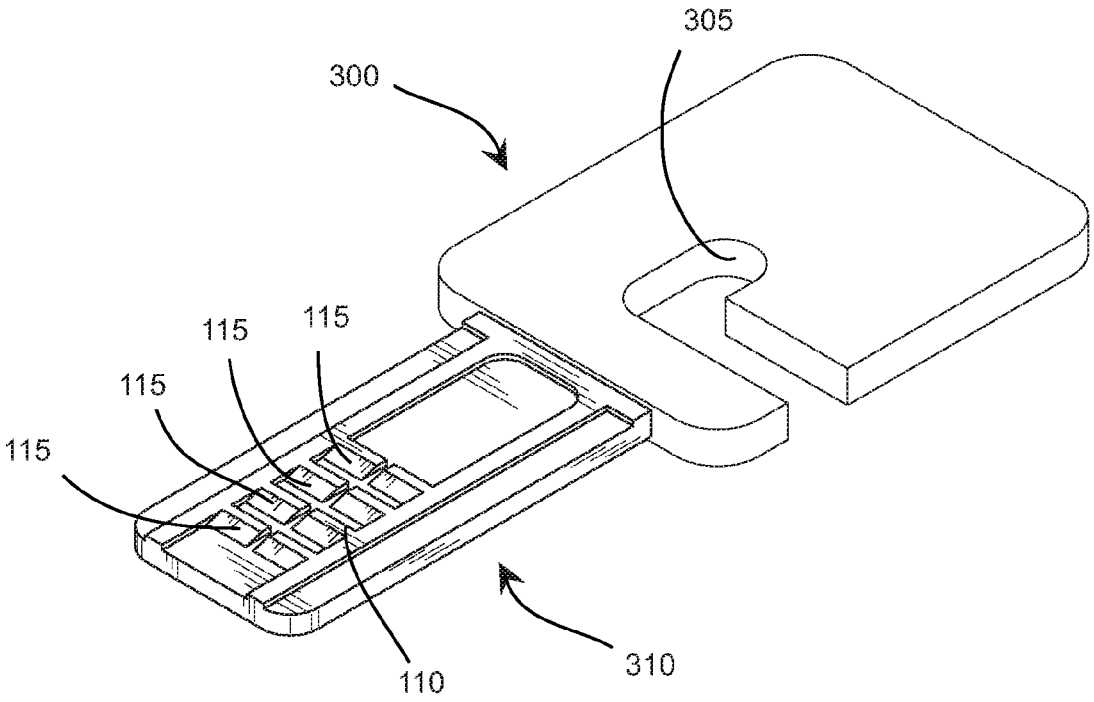
FIG. 7 shows a supplemental accessory for use with the ratcheting belt system including a retail rack hanger.

FIG. 7 shows a supplemental accessory for use with the ratcheting belt system including a retail rack hanger 300. The retail hanger comprises at least one track 310 having a notch strip 110 extending from a hanger clip 305 and body portion thereof. The notch strip comprises a plurality of notches 115 disposed adjacent to one another in series similar to the notch strip of the belt described above. The track 305 can be formed from a rigid plastic, metal, wood, or a pliable material such as leather, or any similar material. The buckle of the ratcheting belt system is engaged with the track 305 for hanging the ratcheting belt system.

Figure 8:
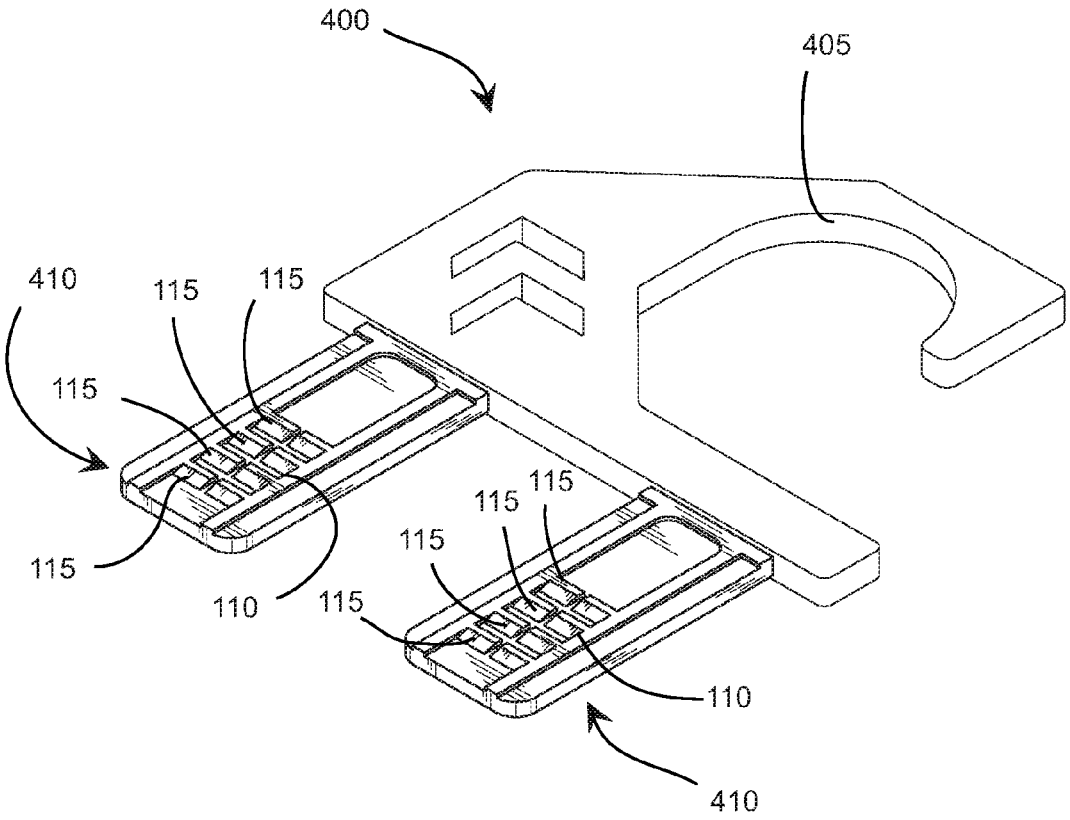
FIG. 8 shows a supplemental accessory for use with the ratcheting belt system including a two-belt closet hanger.

FIG. 8 shows a supplemental accessory for use with the ratcheting belt system including a two-belt closet hanger. The closet hanger 400 comprises a pair of adjacent tracks 410 each having a notch strip 110 extending from a hanger clip 405 and body portion thereof. Each notch strip comprises a plurality of notches 115 disposed adjacent to one another in series similar to the notch strip of the belt described above. The tracks 410 can each be formed from a rigid plastic, metal, wood, or a pliable material such as leather, or any similar material. The buckles of two distinct ratcheting belts are separately engaged with the dual tracks 410 for hanging the ratcheting belts in a standard closed dowel.

Figure 9:
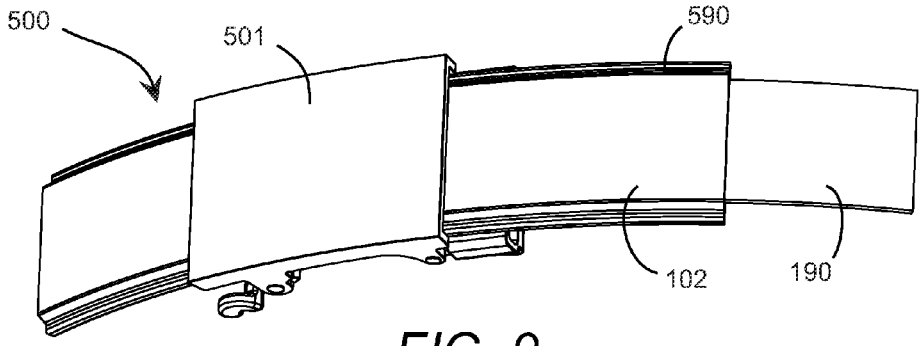
FIG. 9 shows a front view of the rigid ratchet belt system.
Figure 10:
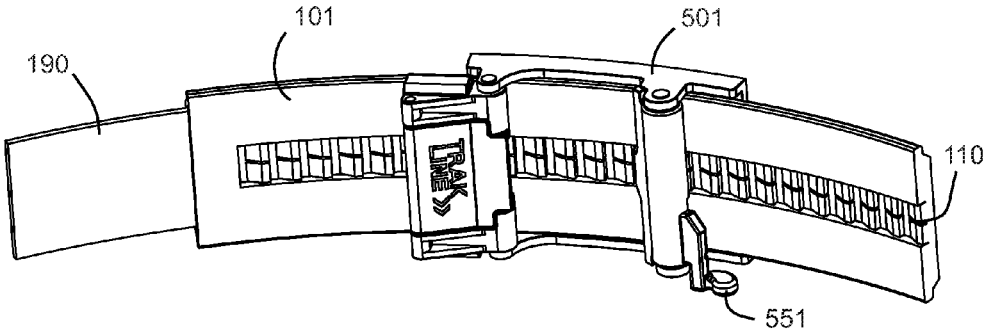
FIG. 10 shows a rear view of the rigid ratchet belt system.
Figure 11:
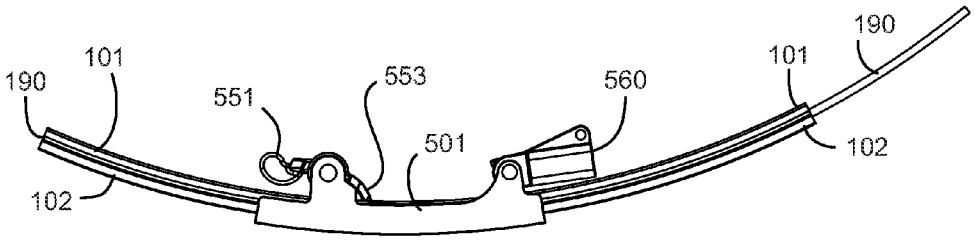
FIG. 11 shows a bottom view of the rigid ratchet belt system.

In accordance with another embodiment, as shown in FIGS. 9-11, a rigid ratchet belt system 500 will include: a belt having a first layer 101, a second layer 102, and an insert 190 disposed therebetween. The insert may comprise a notch strip 110, or may be separate from a distinct notch strip insert. A stitching or other mating element 590 may be implemented to engage the first and second belt layers such that the insert is embedded therein. The belt is coupled to a ratchet belt buckle 501, which further comprises: a buckle body 501, a release lever 551, a receptacle portion 560 for attaching the buckle with the belt, and a ratcheting tab 553 for engaging with corresponding teeth of a notch strip of the belt. FIG. 9 shows a front view of the rigid ratchet belt system. FIG. 10 shows a rear view of the rigid ratchet belt system. FIG. 11 shows a bottom view of the rigid ratchet belt system. The embodiment of FIGS. 9-11 provides a ratchet belt system with enhanced rigidity. Such a belt system can be used in a plurality of applications, including, for example, gun belts, outdoor activities belts, and the like.

Although the illustrated embodiments and the above descriptions are directed toward an embodiment of a waist belt for maintaining a secure fitting of a user's pants about the user's waistline, it will be understood by those having skill in the art that the ratcheting mechanism, including the buckle, ratcheting mechanism, and notch strip, can be incorporated various products, including but not limited to: a waist belt, luggage, bag, carrying case, adjustable strap product, or other article of manufacture which benefits from an adjustable strap and buckle.

What is claimed is:

1. A ratchet belt system, comprising:

a belt extending from a first end to a second end opposite the first end, the belt comprising a notch strip forming a plurality of notches therein, wherein the notch strip is disposed adjacent to the second end of the belt;

a buckle comprising a ratcheting mechanism, the buckle being configured to attach to the belt at the first end thereof and further configured to slideably receive the second end of the belt through the buckle for creating a releasable engagement between the notch strip of the belt and the ratcheting mechanism of the buckle;

further characterized in that:

said belt comprises a first belt layer, a second belt layer, and a monolithic insert disposed between said first and second belt layers, wherein the first and second belt layers are combined with a mating element to form the belt, and wherein the monolithic insert is embedded between the first and second layers.

2. The ratchet belt system of claim 1, wherein the monolithic insert is configured to provide rigid support of the belt.

3. The ratchet belt system of claim 1 configured as a gun belt with one or more features for carrying a gun therewith.

4. The ratchet belt system of claim 1, wherein the notch strip is integrated with the monolithic insert.

5. The ratchet belt system of claim 1, wherein the notch strip is distinct from the monolithic insert.

6. The ratchet belt system of claim 5, wherein the notch strip is integrated with one of the first and second belt layers.

7. A ratchet belt system, comprising:

a belt having a first end, and a notch strip coupled to a second end thereof;

a buckle with an integrated ratcheting mechanism, the buckle being configured to attach with the belt at the first end thereof, and further configured to slideably receive the second end of the belt through the buckle to form an adjustable engagement between the notch strip of the belt and the ratcheting mechanism of the buckle;

wherein the belt further comprises a first belt layer, a second belt layer, and a monolithic insert disposed between said first and second belt layers, wherein the first and second belt layers are combined with a mating element to form the belt, and wherein the monolithic insert is embedded between the first and second layers.

8. The ratchet belt system of claim 7, wherein the monolithic insert is configured to provide rigid support of the belt.

9. The ratchet belt system of claim 7 configured as a gun belt with one or more features for carrying a gun therewith.

10. The ratchet belt system of claim 7, wherein the notch strip is integrated with the monolithic insert.

11. The ratchet belt system of claim 7, wherein the notch strip is distinct from the monolithic insert.

12. The ratchet belt system of claim 11, wherein the notch strip is integrated with one of the first and second belt layers.

* * * * *